US006793185B2

(12) United States Patent
Joliey

(10) Patent No.: US 6,793,185 B2
(45) Date of Patent: Sep. 21, 2004

(54) SUPPORT FOR A SIGN ADAPTED TO BE SECURED TO A SHELF WITH A NARROW EDGE

(75) Inventor: Bernard Joliey, Vernouillet (FR)

(73) Assignee: Store Electronic Systems - Electronic Shelf Label, Bezons (FR)

( * ) Notice: Subject to any disclaimer, the term of this patent is extended or adjusted under 35 U.S.C. 154(b) by 0 days.

(21) Appl. No.: 10/315,064

(22) Filed: Dec. 10, 2002

(65) Prior Publication Data

US 2003/0122047 A1 Jul. 3, 2003

(30) Foreign Application Priority Data

Dec. 10, 2001 (FR) ..... 01 15894

(51) Int. Cl.[7] ..... A47G 29/00; G09F 3/18

(52) U.S. Cl. ..... 248/220.21; 248/300; 248/558; 248/909; 248/316.7; 248/222.13; 40/661.03; 40/658; 211/119.003

(58) Field of Search ..... 248/300, 548, 248/558, 220.21, 220.22, 222.13, 222.51, 228.2, 229.21, 231.31, 231.9, 316.7, 909, 923; 40/661.03, 651, 658, 650, 654.01, 649, 642.02; 211/119.003, 94.01

(56) References Cited

U.S. PATENT DOCUMENTS

| | | | | | |
|---|---|---|---|---|---|
| 2,856,711 | A | * | 10/1958 | Hobbs | 40/651 |
| 4,295,288 | A | * | 10/1981 | Westberg | 40/661 |
| 4,531,311 | A | * | 7/1985 | Howard et al. | 40/649 |
| 4,942,498 | A | * | 7/1990 | Toussaint | 361/709 |
| 5,044,104 | A | | 9/1991 | Hopperdietzel | |
| 5,860,537 | A | * | 1/1999 | Loew | 211/104 |
| 5,863,019 | A | * | 1/1999 | Rose et al. | 248/205.3 |
| 5,899,011 | A | * | 5/1999 | Brinkman | 40/661.03 |
| 6,035,569 | A | * | 3/2000 | Nagel et al. | 40/661.03 |
| 6,105,295 | A | * | 8/2000 | Brinkman et al. | 40/661.03 |
| 6,119,990 | A | * | 9/2000 | Kump et al. | 248/220.22 |
| 6,126,125 | A | * | 10/2000 | Dalton et al. | 248/205.2 |
| 6,450,471 | B1 | * | 9/2002 | Wear | 248/489 |
| 6,553,702 | B1 | * | 4/2003 | Bacnik | 40/661.03 |
| 6,637,716 | B2 | * | 10/2003 | Wear | 248/489 |
| 6,665,971 | B2 | * | 12/2003 | Lowry et al. | 40/661 |

FOREIGN PATENT DOCUMENTS

| | | | |
|---|---|---|---|
| DE | 3513641 A | * | 10/1986 |
| WO | 93/19448 | | 9/1993 |
| WO | WO 97/48862 | * | 12/1997 |
| WO | 98/58360 | | 12/1998 |

* cited by examiner

*Primary Examiner*—Leslie A. Braun
*Assistant Examiner*—Naschica S. Morrison
(74) *Attorney, Agent, or Firm*—Young & Thompson

(57) ABSTRACT

A sign support comprises a rear portion (1) and a front portion (2) interconnected by a flexible hinge (3), and means for adjusting the inclination of the front portion (2) relative to the rear portion (1). An abutment element (12) is connected by a breakable connection (13) to one of said rear and front portions (1 and 2) and defines with the latter a trough (12) of which one free edge constitutes an abutment to define a first position, substantially vertical, of the front portion (2), said abutment element (12) being adapted to be removed by rupture of the breakable connection (13) to define a second position of the front portion (2) of downward inclination.

20 Claims, 2 Drawing Sheets

SUPPORT FOR A SIGN ADAPTED TO BE SECURED TO A SHELF WITH A NARROW EDGE

BACKGROUND OF THE INVENTION

The present invention relates generally to a support for a sign.

In a manner known per se, signs can be paper signs or electronic signs whose use is widespread at present in stores, particularly in supermarkets.

An electronic sign is present in the form of a housing, generally rectangular parallelepipedal, fairly flat, on the front surface of which is disposed a display element, for example a liquid crystal display screen. The display is controlled by a microprocessor, for example remotely controlled by the central computer of the store.

There is known from the international application published under No. WO 98/58360, such an electronic sign and a rail permitting the position of the latter on the front edge of shelves of display units on which are disposed products offered for sale.

The sign and the rail comprise means ensuring emplacement of the sign by snapping into the rail which are such that although it is easy to emplace the sign in the rail, it is impossible to move said sign along the rail or to remove it from said rail without a suitable tool.

Known supports are usually of a width suitable for their positioning on the edge of the most usual shelves, which is to say shelves whose edge has a thickness of the order of 3 to 4 centimeters.

Such a sign support is for example described in international application published under No. WO 93/19448 filed by HL Display. This support is comprised by a rear portion adapted to be fixed to a shelf and a front portion adapted to receive at least one sign, said front and rear portions being connected by a flexible hinge. A tongue connected to one of the front and rear portions by another flexible hinge and carrying at least one snap-in means, and supplemental means carried by the back of the front portion or by the front surface of the rear portion, permit adjusting the inclination of the front portion relative to the rear portion. Such an adjustment permits rendering more easy the reading of signs positioned on shelves at a great or small height, especially when the sign is an electronic sign because the display screens are not easily readable unless disposed in a plane substantially perpendicular to the axis of reading.

The support disclosed in international application of HL Display nevertheless has several drawbacks. First of all, it is expensive to produce because it requires the use of a complex procedure to permit the formation of the two flexible hinges and means for adjusting the inclination. Moreover, if it permits inclining the sign upwardly so as to facilitate the reading of signs positioned in front of shelves located at a low height, the support does not permit inclining the sign downwardly to facilitate reading of the signs disposed at a greater height.

Moreover, because the adjustment means of the inclination are located between the front and rear portions, and hence hidden by the front portion, the snap-in operation or the snap-in means of the tongue in the supplemental means is carried out blind and hence is inconvenient. Finally, it can happen that a client withdrawing a product from a shelf knocks the bottom of the back of the front portion of the sign support installed on the shelf immediately above and causes the snap-in means to unsnap from the tongue relative to the supplemental means, thereby destroying the adjustment of the inclination which can be re-established only by manual intervention.

There exists at present a tendency to use shelves whose edge is much less thick, for example shelves of bent sheet metal, whose edge has a thickness of 25 mm, or glass plates on which are to be positioned supports of suitable sizes.

Such shelves with a narrow edge have the advantage of permitting an increase in the height available between shelves to offer for sale products of the greatest height without changing the interval of vertical spacing of the shelves, or permitting, at the same heights for the products offered for sale, a decrease in the vertical interval of spacing of the shelves and adding at least one supplemental upper shelf. In the second case, the need to have available shelf supports which, when they are installed on upper shelves, permit inclining the signs downwardly to facilitate reading, is even greater. Moreover, with shelves with a narrow edge, the sign supports project more downwardly below the shelves. As a result, the risks that the front portion of the sign support will be knocked from behind when a client withdraws a product from a shelf, and hence the risk of destruction of the adjustment of the inclination of the sign or of the signs carried by the knocked support, are greater.

SUMMARY OF THE INVENTION

The object of the present invention is thus to provide a sign support for products presented on shelves with a narrow edge, which will be simple to make, and hence less costly, with the help of which the sign can be presented at different inclinations both upward and downward, and with which, in the case of knocking from behind the front portion of the sign support, said front portion will then automatically return to the vertical or inclined upwardly or downwardly position which it initially had.

To this end, the invention provides a sign support comprising a rear portion adapted to be fixed to a shelf with a narrow edge and a front part adapted to receive a sign and connected to the rear part by a flexible hinge located in an upper region of said front and rear parts, and means for adjusting the inclination of the front part relative to the rear part, characterized in that said adjustment means comprise a first abutment element, which is connected in a single piece with a first breakable connection to one of said front and rear parts and which defines with the latter a trough whose free edge constitutes a first abutment against or with which said front portion bears by gravity on the rear portion to define a first position, substantially vertical, of the front portion relative to the rear portion, said first abutment element being adapted to be removed by sectioning or rupturing of the first breakable connection to define a second position of the front portion in which the latter bears by gravity against the rear portion while adopting a downwardly inclination.

The support according to the invention is further remarkable in that:

- the rear portion comprises a vertical tongue adapted to be positioned in front of the edge of the shelf and the first abutment element is connected by the first breakable connection to the lower end of the vertical tongue of the rear portion,
- the first abutment element in the form of a trough has, on the side of the free edge of the trough, a substantially horizontal edge against or with which said front portion bears to define said first position,
- said edge is connected to said trough by a second breakable connection and can be removed by sectioning or rupture of said second breakable connection to define a third position, intermediate between said first and second positions, of said front portion, said adjustment means comprise moreover a second abutment element comprising two branches forming an angle between them, of which one of the branches is adapted to be inserted and resiliently gripped in the trough formed by the first abutment element, and whose other branch has a length such that it is adapted to extend beyond the free edge of the trough, in the direction of the other of said front and rear portions, and to constitute a second abutment to define a fourth position of the front portion in which the latter bears by gravity on the rear portion, against or with the second abutment, while adopting an upward inclination, the two branches of the second abutment element make an angle such that said other branch extends substantially perpendicularly to the other of said front and rear portions when said front portion is in the fourth position, the branches of the second abutment element are of different lengths, such that it is possible to give to said front portion two orientations, upward, by insertion of one or the other branch of the first or second abutment element into the trough, at least one of the two branches of the second abutment element comprises a line of weakening such that the length of the branch comprising the line of weakening can be shortened by bending said branch along the line of weakening or by removal of an external portion of said branch by sectioning or rupture along the line of weakening, to decrease the inclination of the front portion upwardly, the vertical tongue comprises at least one opening in which can be emplaced an attachment for the securement of the support with an edge directed vertically downwardly of a shelf of bent sheet metal, when the support is to be positioned in front of a shelf whose vertical edge is bent so as to provide a groove having a C cross-section, said attachment comprises a head connected by a short rod to a cam having a symmetrical contour relative to the axis of the rod, such that, in a first angular position of the cam, the latter is adapted to be engaged in said groove with a C section and, in a second angular position of the cam, obtained by rotating said cam about 90°, the latter is wedged in said groove with a C cross-section, the cam has a contour which has two large surfaces parallel to each other and connected to each other, at each of their ends by a series of facets whose distance relative to the axis of the rod increases from one large side to the other large side of said contour, said attachment is monobloc, said opening is rectangular with its large sides disposed horizontally, and the attachment head has a rectangular contour whose large sides have a length smaller than that of the large sides of said rectangular opening and larger than that of the small sides of said rectangular opening and whose small sides have a length less than that of the small sides of the rectangular opening, said attachment is in two parts adapted to be assembled permanently to each other, after passage of the rod of the attachment through the opening of the vertical tongue and of said rear portion, by snapping in said rod, which is secured to one of the two portions of the attachment, into the other of the two portions of the attachment, the, head of the attachment has a contour of larger size than that of the opening of the vertical tongue of said rear portion, the rear portion comprises a horizontal tongue adapted to be positioned on top of the shelf, a portion of said horizontal tongue is detachable along a breakable connection, the rear portion of the support comprises two horizontal tongues constituting with an upper portion of the vertical tongue a securement clamp adapted to be forcibly placed astride the edge of the shelf, the two horizontal tongues of the rear portion have, on their mutually facing surfaces, anti-slip formations and/or cladding preventing movement of said gripper toward the front of a shelf, the front and rear portions of the support are constituted by a profile co-extruded with the flexible hinge and sectioned to a desired length, the front portion has the shape of a segment of a rail overall constituted by a bottom and two upper and lower wings perpendicular to said bottom and constituting hooking and retention means for at least one electronic sign.

BRIEF DESCRIPTION OF THE DRAWINGS

The invention will be better understood from the description which follows, given by way of non-limiting example, with reference to the accompanying drawings, in which.

DETAILED DESCRIPTION OF THE PREFERRED EMBODIMENTS

Figure 1:
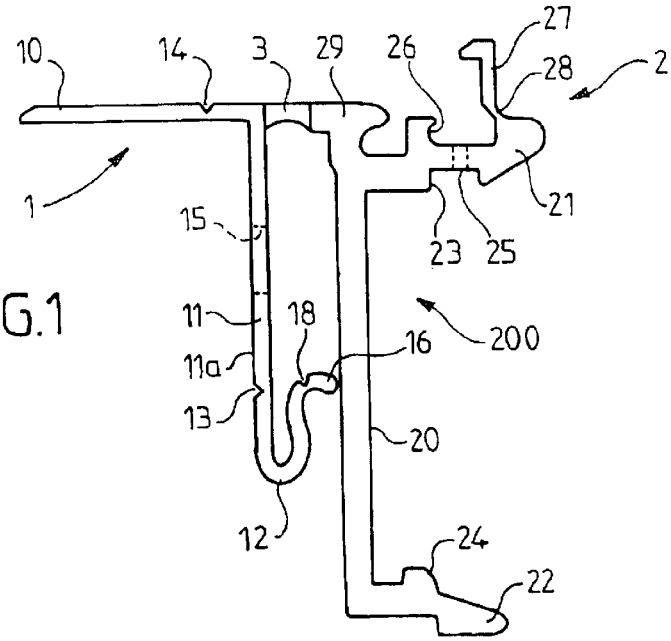
FIG. 1 is an end view of a sign support according to the invention.

The support seen in FIG. 1 is overall constituted by a rear portion 1 adapted to be fixed to a shelf with a narrow edge and a front portion 2 adapted to receive a sign not shown in the drawing. Said front and rear portions 1 and 2 are connected by a flexible hinge 3 so as to permit rotational movement of one of them relative to the other.

This support is made by extrusion of plastic material, the flexible hinge being co-extruded with the front and rear portions 1 and 2.

Said rear portion 1 comprises a vertical tongue or wing 11 disposed perpendicularly to a horizontal tongue or wing 10. The vertical tongue 11 is adapted to be positioned in front of the edge of the shelf, not shown in FIG. 1.

A trough 12 is connected integrally to the lower end of said vertical tongue 11 along a first edge by means of a breakable connection 13. The trough 12 terminates along its second edge in a rim 16 that is substantially horizontal, directed toward the front portion 2.

The breakable connection 13 of the vertical tongue 11 permits detaching the trough 12. Such a breakable connection is, in a way known per se, constituted by a thinning of the sheet of plastic material constituting the vertical tongue 11. Said sheet of plastic material can thus be bent and broken at the level of this thinning.

At least one opening 15 is pierced in the vertical tongue 11, this opening is adapted for the emplacement of an attachment for the securement of the support. The support according to the invention being made by extrusion, it is present in the form of a profile of great length comprising regularly spaced openings 15, for example with an interval of about 40 millimeters along a horizontal line extending over all the length of the support. When said profile is sectioned to the desired length, the cutouts are effected such that the section comprises at least one opening and preferably two openings disposed symmetrically. The selected interval of 40 millimeters is particularly adapted for cutting out supports adapted for the emplacement of electronic signs. Thus, electronic signs usually have a length of 69 or 109 millimeters, the supports adapted to their emplacement could thus comprise respectively 2 or 3 openings.

The openings 15 can be rectangular with their large sides disposed horizontally.

The horizontal tongue or wing 10 of the rear portion 1 is adapted to be positioned on the upper surface of the shelf (not shown in the drawing). The tongue 10 permits aligning the height of the support with the upper surface of the shelf and to ensure the horizontality of said support. A breakable connection 14 is provided near the end of said horizontal tongue by which it is connected to the vertical tongue 11.

In the example shown in the drawing, the front portion 2 is overall constituted by a rail segment 200 adapted to ensure the positioning and holding of an electronic sign. As a modification, said front portion can be formed by a pocket between the walls of which will be positioned a thin sign, for example of paper or cardboard.

The rail segment 200 is provided with a connection portion 29 by which it is connected to the flexible hinge 3.

Said rail 200 is overall constituted by a bottom 20 and two upper and lower wings 21 and 22 perpendicular to said bottom 20.

In the embodiment shown in FIG. 1, wings 21, 22 have at their free end, oblique surfaces inclined away from each other in the direction away from the bottom 20 of the rail 200.

The upper wing 21 has a longitudinal groove 23 formed in its internal surface turned toward the lower wing 22. The lower wing 22 has a longitudinal rib 24 formed on its internal surface turned toward the upper wing 21.

The openings 25 are provided in the bottom of the groove 23, regularly spaced along the length of the rail 200.

The upper wing 21 also has a longitudinal groove 26 formed in its external surface and a flap 27 for closing said groove 26. The flap 27 is connected to the external surface of the upper wing 21 by a film hinge 28. The free end of said flap 21 and the wall of the groove 26 opposite that bearing the film hinge of said flap are shaped such that the end of said flap can be snapped into the wall of the groove 26 whereby said groove 26 will be closed by said flap 27.

Said flap 27 permits, in its position closing the groove 26, to make the openings 25 inaccessible from outside the rail 200.

The lower wing 22 carries a rib 24 formed on its internal surface turned toward the upper wing 21.

In a manner known per se, the rail 200 is adapted for the emplacement of an electronic sign (not shown in the drawing), which is present in the form of a flat parallelepipedal body having a display screen on its front surface, the rib 24, groove 23 and openings 25 constituting hooking and retention means for said electronic sign.

In its lower surface, the sign has a groove adapted to coact with the rib 24 of the lower wing 22 of the rail 200, whilst on its upper surface, said sign carries a retractable finger pressed by resilient means and adapted to position itself in one of the openings 25 of the upper wing 21.

When the support according to the invention is positioned on the end of a shelf and has one or two electronic signs, the front portion 2 pivots about the flexible hinge 3 because of gravity, to arrive in abutment against the edge 16.

The trough 12, more precisely the edge 16 of this latter, constitutes the first abutment element limiting the rotation of said front portion 2 such that the latter will be in a first position in which it is disposed in a substantially vertical plane, as will also the display screen of the sign.

In a manner known per se, the display screen for an electronic sign is usually a liquid crystal screen, and it is thus desirable that its plane be positioned substantially perpendicular to the axis of vision of the reader.

In the embodiment shown in FIG. 1, the support according to the invention is thus adapted to be used on shelves located at medium heights.

Figure 3:
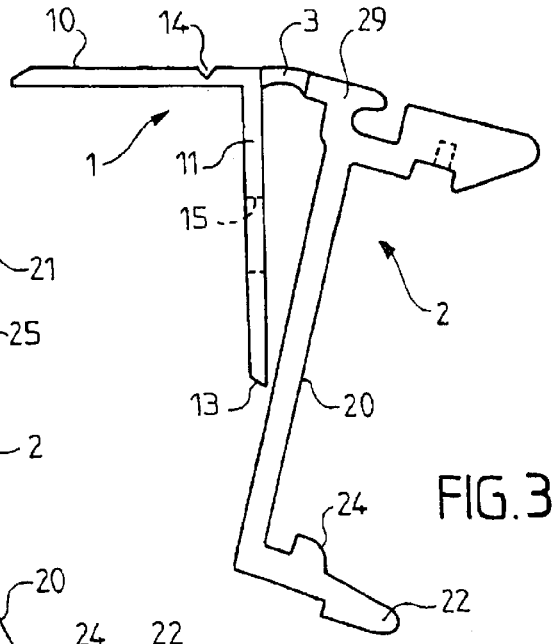
FIG. 3 is an end view of the support of FIG. 1 with the sign oriented downwardly.

As can be seen in FIG. 3, when it is necessary to outfit shelves located at a greater height, the lower portion of the vertical tongue 11, constituted by the trough 12 and the rim 16, is separated from the rear portion 1 at the level of the breakable connection 13 by sectioning or rupturing the latter. The front portion 2 is then free to move relative to the rear portion 1 into a second position in which the bottom 20 bears against the lower end of the vertical tongue that has thus been shortened. The sign carried by the front portion 2 is thus oriented downwardly.

According to a modification not shown in the drawing, the rim 16 of the trough 12 can be removed by sectioning or rupturing a breakable connection 18. The front portion 2 then takes a third position, intermediate said first and second positions.

Figure 2:
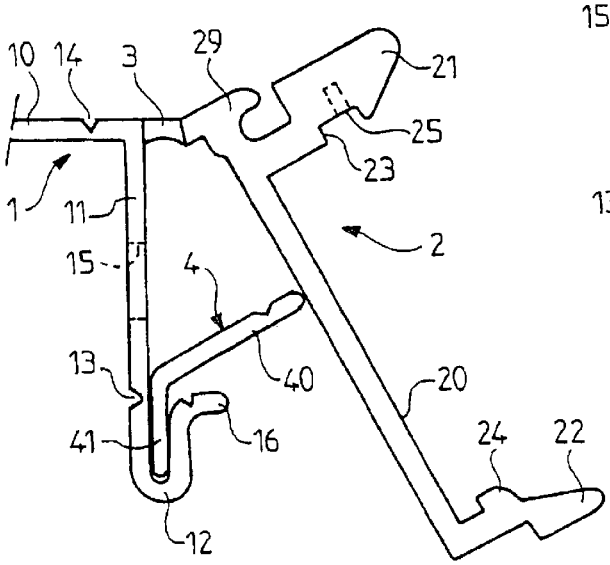
FIG. 2 is an end view of the support of FIG. 1 with the sign oriented upwardly.

When it is desired to outfit shelves located at a lower height, the invention proposes to use a second abutment element 4 as shown in FIG. 2. Such a second abutment element 4 is elbowed and is constituted by two branches 40, 41 forming an angle between them. One of the branches, the branch 41 in the example shown in FIG. 2, is inserted and resiliently held in the trough 12 whilst the other, the branch 40, extends forwardly, in the direction of the front portion 2. The bottom 20 of the front portion 2 is positioned by gravity against the free end of the branch 40, in a fourth position in which the sign held by the support is inclined upwardly.

It is preferable but not necessary that the branch of the second abutment element 4, against which abuts the bottom 20 of said front portion 2, be disposed substantially perpendicularly to said bottom.

It is thus possible to provide abutment elements 4 whose branches 40, 41 are of different lengths so as to permit, by use of a single abutment 4, the positioning of the sign in two different orientations by insertion of the branch 40 or the branch 41 in the trough 12.

According to still another modification not shown in the drawing, at least one of the branches 40, 41 of said second abutment element 4 comprises a line of weakening such that the length of the branch comprising the line of weakening can be shortened by bending said branch along the line of weakening or by removal of an external portion of said branch by sectioning or rupture along the line of weakening, to decrease the inclination of the front portion upwardly.

The support shown in FIG. 1 can be mounted on a shelf with a narrow edge by the use of adhesive means below the horizontal tongue 10.

Figure 4:
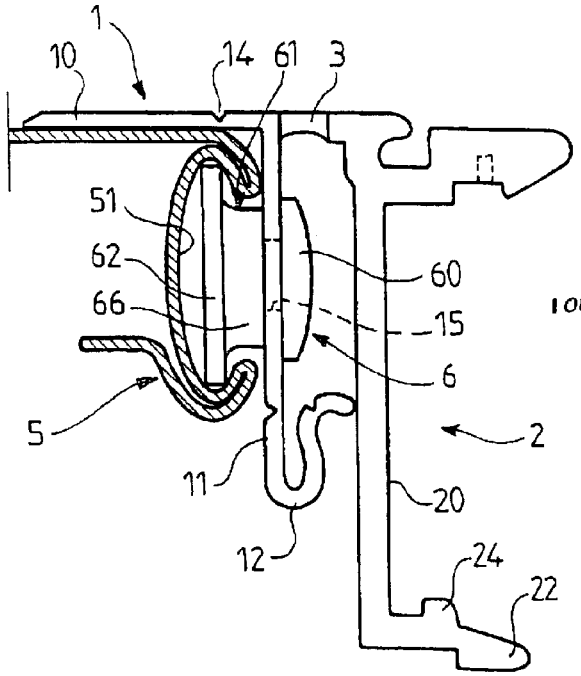
FIG. 4 is an end view showing the mounting of a support according to the invention on a shelf with a longitudinal trough.

It can also be mounted, as shown in FIG. 4, by the emplacement of attachments 6 introduced through the openings 15 of the vertical tongue 11 and adapted to ensure the securement of the support to a downwardly directed edge 5 of a shelf of bent sheet metal. Said attachments can be screws, for example self tapping, screwed into said edge.

The edge 5 of certain shelves, as is shown in FIG. 4, has a longitudinal groove 51 with a C shape, made by bending sheet metal.

The attachments 6 are thus constituted by a head 60, a short rod 61 and a cam 62 having a contour symmetrical relative to the axis of the rod, such that, in a first angular position of the cam, the latter is adapted to be engaged in said groove 51 and, in a second angular position of the cam, obtained by rotation by about 90° of said cam, the latter is wedged into said groove 51.

When this opening 15 of the vertical tongue 11 is rectangular with its large sides disposed horizontally, the head 60 of the attachment 6 has a rectangular contour whose large sides have a length less than that of the large sides of said opening 15 but larger than that of the small sides of said opening 15 and whose small sides have a length smaller than that of the small sides of said opening 15.

Figure 5:
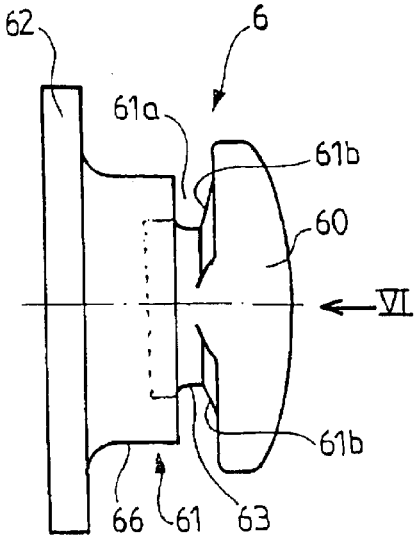
FIG. 5 is a side view of an attachment for hooking the support according to the invention to the horizontal trough of a shelf.
Figure 6:
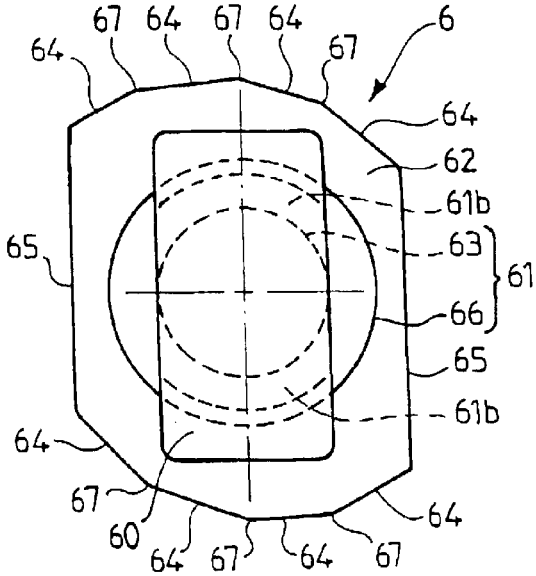
FIG. 6 is a view in the direction of the arrow VI of FIG. 5.

In the embodiment shown in FIGS. 5 and 6, the attachment 6 is of one piece. The rod 61 comprises a portion 63 passing through the vertical tongue 11 and a portion 66 extending into the groove 51 of the edge 5 of the shelf when the support is in place on the shelf. The portion 66 defines with the head 60 a throat 61*a* whose width corresponds to the thickness of the vertical tongue 11 of the rear portion 1. The portion 63 of the rod 61 is connected to the head 60 by two chamfers 61*b*.

The cam 62 has two large sides 65 parallel to the large sides of the head 60 and spaced a distance slightly less than the height of the opening of the C-shaped groove 51. Two series of facets 64 whose distance from the axis of the rod 61 increases from one large side 65 to the other large side 65, interconnect said large sides.

The attachment 6 is emplaced on the support by introducing the head 60 through an opening 15, from the rear surface 11*a* of the vertical tongue 11, then the attachment 6 is turned through a small angle so as to obtain, thanks to the two chamfers 61*b*, a slight wedging of the large sides of the opening 15 of the vertical tongue 11 in the throat 61*a* of the attachment 6. This permits holding a temporary connection between the attachment 6 and the vertical tongue 11 before this latter is applied and fixed to the edge 5 of the shelf. Then the cam 62 of the attachment is introduced into the groove 51. The attachment 6 is then turned by about a quarter of a turn in a clockwise direction by means of a suitable tool (gripper or key with a rectangular eyelet adapted to the head 60). In the course of this rotation, ridges 67, opposed two by two, between the facets 64, brush against the upper and lower walls of the groove 51 and constitute hard points which must be freed until it is no longer possible to drive the attachment in rotation. At this time, two opposite facets 64 of the cam 62 are in contact with the upper and lower walls of the groove 51, which ensures the securement of the sign support to the shelf. The rotation in a reverse direction of the attachment 6 is braked by said ridges 67, which avoids all untimely disassembly of the support.

According to a modification not shown in the drawing, the attachment 6 is in two portions adapted to be assembled permanently to each other, after passage of the rod 61 of the attachment through the opening 15 of the vertical tongue 11 of said rear portion 1, by snap fitting of said rod, which is secured to one of the two portions of the attachment, into the other of the two portions of the attachment. In this embodiment, the opening or openings 15 can have a circular shape with a diameter slightly greater than that of the rod 61, and the head 60 of the attachment 6 has a contour of larger dimension than that of the opening 15 of the vertical tongue 11 of said rear portion 1 of the support and carries means for being driven in rotation.

When the support according to the invention is hooked onto a shelf by means of attachments 6, it is possible to detach a portion of the horizontal tongue 10 along the breakable connection 14 so as to make accessible the openings usually formed along the free edge of shelves for the emplacement of separators.

Figure 7:
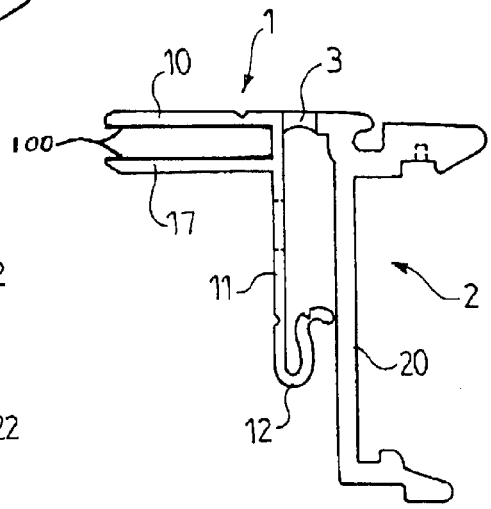
FIG. 7 is a modified embodiment of the support according to the invention.

In the embodiment shown in FIG. 7, the rear portion 1 of the support comprises two horizontal tongues 10, 17 constituting with an upper portion of the vertical tongue 11 a gripper for securement adapted to be forcibly placed astride the edge of a very thin shelf such as a glass shelf. The mutually facing surfaces of this securement gripper are for example, and in a manner known per se, provided with formations and/or a coating 100 with a high coefficient of friction preventing displacement of said gripper forwardly of the shelf. Said surfaces can also be coated with cement so as to ensure the securement of the support to a shelf.

In another modified embodiment not shown in the drawings, instead of being connected to the vertical tongue 11 of the rear portion 1, the trough 12 is connected by a breakable connection to the back 20 of the front portion 2 such that said trough bears against the front surface of the vertical tongue 11 of the rear portion 1.

What is claimed is:

1. Support for a sign comprising: a rear portion (1) adapted to be fixed to a shelf with a narrow edge and a front portion (2) adapted to receive a sign and connected to the rear portion (1) by a flexible hinge (3) located in an upper region of said front and rear portions (2 and 1), and means for adjusting the inclination of the front portion (2) relative to the rear portion (1), characterized in that said adjustment means comprise a first abutment element (12), which is connected in a single piece by a first breakable connection (13) to one of said rear and front portions (1 and 2) and which defines with the latter a trough (12) of which a free edge constitutes a first abutment against or with which said front portion (2) bears by gravity on the rear portion (1) to define a first substantially vertical position of the front portion (2) relative to the rear portion (1), said first abutment element (12) being adapted to be removed by sectioning or rupture of the first breakable connection (13) to define a second position of the front portion (2) in which the latter bears by gravity against the rear portion (1) to adopt a downward inclination.

2. Support according to claim 1, characterized in that the rear portion (1) comprises a vertical tongue (11) adapted to be positioned before the edge of the shelf and the first abutment element (12) is connected by the first breakable connection (13) to the lower end of the vertical tongue (11) of the rear portion (1).

3. Support according to claim 1, characterized in that the first abutment element in the form of a trough (12) has, on the side of the free edge of the trough (12), a substantially horizontal rim (16) against or with which said front portion (2) bears to define said first position.

4. Support according to claim 3, characterized in that said rim (16) is connected to said trough (12) by a second breakable connection (18) and can be removed by sectioning or rupturing said second breakable connection (18) to define a third position, intermediate said first and second positions, of said front portion (2).

5. Support according to claim 1, characterized in that said adjustment means comprise a second abutment element (4) comprising two branches (40, 41) forming an angle between them, of which one of the branches (41) is adapted to be inserted and resiliently held in the trough (12) formed by the first abutment element, and of which the other branch (41) has a length such that the other branch is adapted to extend beyond the free edge of the trough (12), in the direction of the other of said front and rear portions (2 and 1), and to constitute a second abutment to define a fourth position of the front portion (2) in which the latter bears by gravity on the rear portion (1), against or with the second abutment, by adopting an upward inclination.

6. Support according to claim 5, characterized in that the two branches (40, 41) of the second abutment element (4) form an angle such that said other branch extends substantially perpendicularly to the other of said front and rear portions (2 and 1) when said front portion (2) is in the fourth position.

7. Support according to claim 5, characterized in that the branches (40, 41) of the second abutment element (4) are of different lengths, such that said front portion (2) can have two possible orientations upwardly, by insertion of one or the other branch of the second abutment element (4) into the trough (12).

8. Support according to claim 5, characterized in that at least one of the two branches (40, 41) of the second abutment element (4) comprises a line of weakening such that the length of the branch comprising the line of weakening can be shortened by bending said branch along the line of weakening or by removal of an external portion of said branch by sectioning or rupture along the line of weakening, to decrease the inclination of the front portion upwardly.

9. Support according to claim 2, characterized in that the vertical tongue (11) comprises at least one opening (15) in which can be emplaced an attachment (6) for the securement of the support to an edge directed vertically downwardly of a shelf in bent metal.

10. Support according to claim 9, characterized in that when the support is adapted to be positioned before a shelf whose vertical edge is bent so as to provide a groove (51) having a C cross-section, said attachment (6) comprises a head (60) connected by a short rod (61) to a cam (62) having a symmetrical contour relative to the axis of the rod (61), such that, in a first angular position of the cam (62), the latter is adapted to be engaged in said groove (51) with a C cross-section and, in a second annular position of the cam (62), obtained by rotation of said cam (62) by about 90°, the latter is wedged in said groove (51) of C cross-section.

11. Support according to claim 10, characterized in that the cam (62) has a contour with two large sides (65) parallel to each other and connected to each other, at each of their ends by a series of facets (64) whose distance relative to the axis of the rod (61) increases from one large side (65) to the other large side (65) of said contour.

12. Support according to claim 11, characterized in that said attachment (6) is monobloc, said opening (15) is rectangular with sides of said rectangular opening of large dimension disposed horizontally, and the head (60) of the attachment (6) has a rectilinear contour whose large sides are of a length less than that of the large sides of said rectangular opening (15) and larger than that of the small sides of said rectangular opening (15) and whose sides of small dimension have a length smaller than that of the small sides of said rectangular opening (15).

13. Support according to claim 10, characterized in that said attachment (6) is in two parts adapted to be assembled permanently to each other, after passage of the rod (61) of the attachment (6) through the opening (15) of the vertical tongue (11) of said rear portion (1), by snapping in of said rod, which is secured to one of the two portions of the attachment (6), into the other of the two portions of the attachment (6).

14. Support according to claim 13, characterized in that the head (60) of the attachment (6) has a contour of larger dimension than that of the opening (15) of the vertical tongue (11) of said rear portion (1).

15. Support according to claim 1, characterized in that the rear portion (1) comprises a horizontal tongue (10) adapted to be positioned on the top of the shelf.

16. Support according to claim 15, characterized in that a portion of said horizontal tongue (10) is detachable along a breakable connection (14).

17. Support according to claim 1, characterized in that the rear portion (1) of the support comprises two horizontal tongues (10, 17) constituting with an upper portion of the vertical tongue (11) a gripper of a configuration adapted to be disposed forcibly astride the edge of the shelf.

18. Support according to claim 17, characterized in that the two horizontal tongues (10, 17) of the rear portion (1) have, on their mutually facing surfaces, anti-slip formations and/or coating preventing a movement of said gripper toward the front of the shelf.

19. Support according to claim 1, characterized in that the front and rear portions (2 and 1) of the support are constituted by a profile co-extruded with the flexible hinge (3) and sectioned to a desired length.

20. Support according to claim 19, characterized in that the front portion (2) has the overall shape of a rail segment constituted by a bottom (20) and by two upper and lower wings (21 and 22) perpendicular to said bottom (20) and comprising hooking and retention means for at least one electronic sign.

* * * * *